US008361251B2

(12) United States Patent
Luo et al.

(10) Patent No.: US 8,361,251 B2
(45) Date of Patent: Jan. 29, 2013

(54) HIGH DUCTILITY/STRENGTH MAGNESIUM ALLOYS

(75) Inventors: Aihua A. Luo, Troy, MI (US); Raja K Mishra, Shelby Township, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 751 days.

(21) Appl. No.: 12/254,460

(22) Filed: Oct. 20, 2008

(65) Prior Publication Data

US 2009/0116994 A1 May 7, 2009

Related U.S. Application Data

(63) Continuation-in-part of application No. 11/935,439, filed on Nov. 6, 2007.

(51) Int. Cl.
*C22C 23/04* (2006.01)

(52) U.S. Cl. ..... 148/406; 420/405

(58) Field of Classification Search ..... 148/406; 420/405

See application file for complete search history.

(56) References Cited

U.S. PATENT DOCUMENTS

| | | | | |
|---|---|---|---|---|
| 3,231,372 | A * | 1/1966 | Foerster | 420/405 |
| 2005/0194072 | A1 * | 9/2005 | Luo et al. | 148/557 |

FOREIGN PATENT DOCUMENTS

| | | | |
|---|---|---|---|
| CN | 101137762 | | 3/2008 |
| JP | 2002056370 | | 11/2002 |
| JP | 2008156725 | | 7/2008 |
| KR | 20070027642 | | 3/2007 |
| WO | WO 2006095999 | A1 * | 9/2006 |
| WO | 2009014807 | | 1/2009 |

OTHER PUBLICATIONS

NPL-1: Petsol'd et al, Structure of magnesium alloys with zinc and rare earth metals, Translated from Metallovedenie I Termicneskaya Obrabotka Metallov, No. 5, pp. 22-24, May 1971, pp. 369-371.*

Liu, Ying, et al.; Effects of RE on Microstructures and Mechanical Properties of Hot-Extruded AZ31 Magnesium Alloy; Journal of Rare Earths. 2004, vol. 22, No. 4, pp. 527-532.

Zhou, Haitao et al. Effect of Cerium on Microstructures and Mechanical Properties of AZ61 Wrought Magnesium Alloy. Jpurnal of Materials Science. 2004, vol. 39, No. 23, pp. 7061-7066.

Yang, Wan-Gye and Koo, Chun-Hao. Improving the Mechanical Properties of Mg-8A1 Magnesium Alloy by the Re Addition and Hot Extrusion. Bulletin of the College of Engineering, N.T.U. 2003, No. 89 pp. 63-82.

Lapovok, R.Y. et al; Construction of Extrusion Limit Diagram for AZ31 Magnesium Alloy by FE Simulation. Journal of Materials Processing Technology. 2004, vol. 146, pp. 408-414.

International Search Report for PCT/US2008/065252 dated Oct. 28, 2008.

(Continued)

*Primary Examiner* — Jie Yang

(74) *Attorney, Agent, or Firm* — Reising Ethington P.C.

(57) ABSTRACT

A magnesium alloy comprising up to about six weight percent zinc and up to about one weight percent cerium may be hot worked to produce an intermediate or final alloy workpiece that exhibits enhanced ductility and strength at room temperature. The addition of zinc and a small amount of cerium may affect the magnesium alloy by increasing strength and ductility, and improving the work hardening behavior.

8 Claims, 1 Drawing Sheet

OTHER PUBLICATIONS

M.R. Barnett et al., Deformation Microstructures and Textures of Some Cold Rolled Mg Alloys, Materials Science & Engineering, 2004, 205-211, A 386.

Yu Fan et al., Influence of Cerium on the Microstructure, Mechanical Properties and Corrosion Resistance of Magnesium Alloy, 2006, 208-215, A 433.

Toshiji Mukai et al., Ductility Enhancement in AZ31 Magnesium Alloy by Controlling its Grain Structure, Scripta Materialia, 2001, 89-94, 45.

Takeshi Mohri et al., Microstructure and Mechanical Properties of a Mg-4Y-3RE Alloy Processed by Thermo-Mechanical Treatment, Materials Science & Engineering, 1998, 287-294, A 257.

T. Mukai et al., Experimental Study of a Structural Magnesium Alloy with High Absorption Energy Under Dynamic Loading, Scripta Materialia, 1998, 1249-1253, 39.

Chino, Yasumasa; Tensile Properties and Stretch Formability of Mg-1.5 mass%-0.2 mass%Ce Sheet Rolled at 723 K; Materilas Transactions, vol. 49, No. 7 (2008) pp. 1710 to 1712; Express Rapid Publication.

* cited by examiner

HIGH DUCTILITY/STRENGTH MAGNESIUM ALLOYS

This application is a continuation-in-part of U.S. patent application Ser. No. 11/935,439 filed on Nov. 6, 2007, and titled "Forming Magnesium Alloys With Improved Ductility."

TECHNICAL FIELD

This invention generally relates to processed magnesium alloy compositions exhibiting improved ductility and strength at room temperature. More specifically, magnesium alloyed with zinc and cerium is subjected to high temperature deformation to improve the alloy's formability and durability at room temperature.

BACKGROUND OF THE INVENTION

Magnesium is the lightest structural metal. In engineering applications it is alloyed with one or more elements, for example, aluminum, manganese, rare earth metals, lithium, zinc, and silver. Magnesium usually constitutes eighty-five percent by weight or more of these alloys.

The cost of magnesium has decreased dramatically in recent years and magnesium and its alloys have become attractive structural materials for a wide range of applications due in part to desirable physical properties such as light weight, high specific strength and stiffness, machinability, and the ability to be easily recycled. However, the use of magnesium in wrought products like sheets and extrusions has been limited due to the poor workability of magnesium castings and the lower formability and ductility of magnesium in the primary fabricated stage. At room temperature, pure magnesium is generally characterized by limited ductility as a result of its hexagonal close-packed crystal structure and resulting limited number of active slip systems. This inherent limitation often discourages widespread use of magnesium in wrought products made from sheets and extrusions because it is difficult and expensive to process the poorly workable metal into useable finished shapes.

It has been shown that the ductility of Mg-0.2 wt % Ce alloy extrusions is higher than that of magnesium and other known magnesium alloys. However, the yield and tensile strengths of the Mg-0.2 wt % Ce alloy remain low. The addition of aluminum to the Mg-0.2 wt % Ce alloy improves its strength, but significantly decreases its ductility.

Thus, there is a general need to provide magnesium alloys in a primary fabrication stage having improved ductility and strength for fabrication into wrought magnesium metal products.

SUMMARY OF THE INVENTION

It is found that an alloy of cerium, zinc, and magnesium may be cast and then hot-worked in a selected direction or axis of the casting to form a primary or finished material that displays a good combination of ductility and strength at room temperature. A commercial grade of magnesium with its normal incidental impurities may be the base constituent. Cerium is added to a melt of the magnesium in a suitable amount up to about one percent by weight. And zinc is added in a selected amount up to about six percent by weight. Magnesium may be present in the alloy in an amount from about eighty-five percent by weight to about ninety-eight percent by weight.

The molten composition may be cast into a shape in which the principal components are dissolved in the magnesium or generally uniformly dispersed through a magnesium matrix phase. In many embodiments of the invention, the cast shape may be a solid cylinder or a tube with a straight longitudinal axis. The cast object is then heated to a suitable hot working temperature and extruded, for example, at an extrusion rate to produce a substantial reduction in the cross-sectional area of the cylinder or tube. After suitable hot working of the cast composition, it is found that the material has a good combination of ductility and strength at room temperature. The combination of ductility and strength compares favorably to commercial magnesium, to the magnesium-cerium alloys of the above-identified parent application, and to common commercial magnesium alloys such as AZ31.

In an embodiment of the invention, a melt containing, by weight, 2 percent zinc and 0.2 percent cerium and the balance magnesium ("ZE20") was cast into a round cylindrical billet for in-line extrusion. The magnesium was a commercial grade magnesium with small amounts of residual elements from preparation of the ingot material. The billet was preheated to 425° C. for two hours and pushed along a straight axis through a circular die with an extrusion ratio of about 42:1 to produce a tube with a 25 mm outer diameter and a 1.75 mm thickness. The cross-sectional area of the billet was reduced about 42-fold in hot forming the tube. Like extruded tubes were produced consisting of magnesium, 4 weight percent zinc, and 0.2 weight percent cerium ("ZE40"); and magnesium, 6 weight percent zinc, and 0.2 weight percent cerium ("ZE60"). For purposes of comparison of resulting properties, a billet of an alloy consisting of 3 weight percent aluminum, 1 weight percent zinc, and the balance magnesium ("AZ31"); and a billet of an alloy consisting of magnesium (commercial) and 0.2 weight percent cerium ("Mg-0.2 wt % Ce") were cast and extruded in the same way.

The addition of zinc in amounts up to about six percent by weight and cerium in amounts up to about one percent by weight are found to enhance the room temperature ductility and workability of magnesium alloys following suitable hot deformation processing. In a specific embodiment, the hot deformation is accomplished by extrusion at billet temperatures of about 300° C. to about 475° C. with extrusion ratios in the range of about 10:1 to about 60:1 at suitable extrusion speeds. During the hot deformation the billets may be suitably lubricated with graphite based lubricants or boron nitride, although this may not be required.

It should be understood that the detailed description and specific examples, while providing exemplary embodiments of the invention, are intended for illustrative purposes only and are not intended to limit the scope of the invention.

BRIEF DESCRIPTION OF THE DRAWINGS

The disclosure will now be described, by way of example, and not limitation, with reference to the accompanying drawings. The following is a brief description of the drawings.

DESCRIPTION OF PREFERRED EMBODIMENTS

Figure 1:
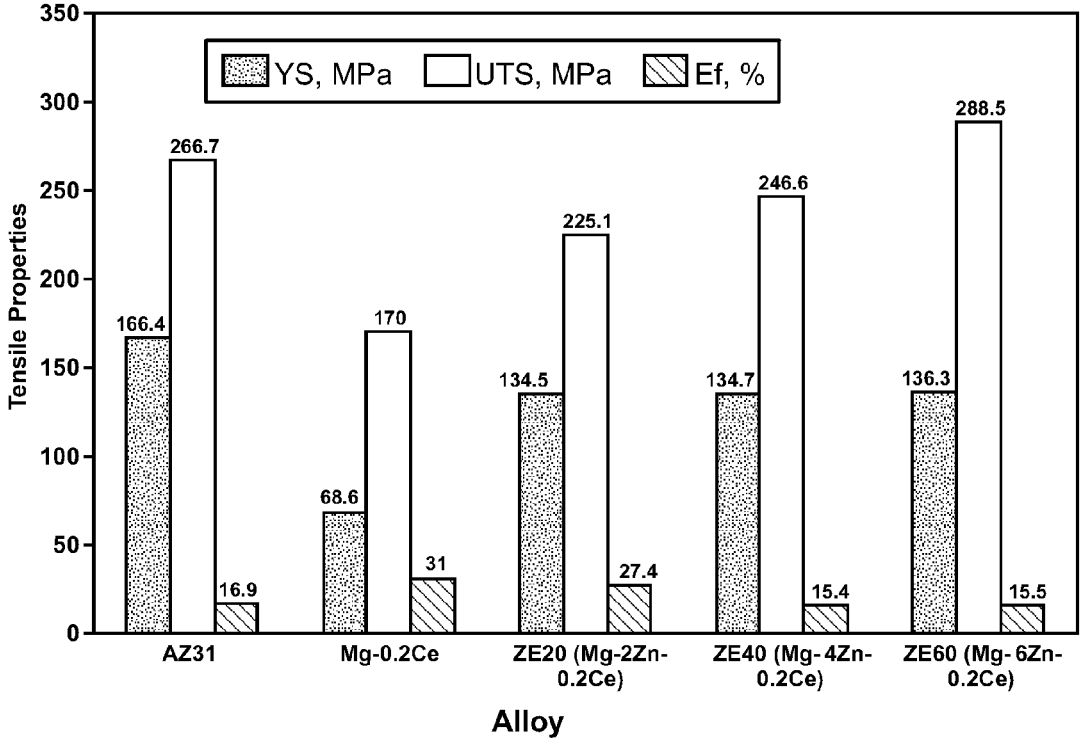
FIG. 1 is a bar graph of tensile properties—yield strength (MPa), ultimate tensile strength (MPa), and elongation at fracture ( % )—for extruded specimens of the following alloys: AZ31, magnesium-0.2wt % cerium, magnesium-2wt % zinc-0.2wt % cerium (ZE20), magnesium-4wt % zinc-0.2wt % cerium (ZE40), and magnesium-6wt % zinc-0.2 wt % cerium (ZE60).

The description of the following embodiment(s) is merely exemplary in nature and is in no way intended to limit the claimed invention, its application, or its uses.

Magnesium alloys comprising primarily magnesium with small additions of zinc and cerium may be formed by a hot deformation process into a wrought article that exhibits improved strength and ductility at room temperature. Here room temperature means a typical indoor ambient temperature of, for example, about fifteen to about thirty degrees Celsius. The wrought article may be in a final product shape. However, the room temperature ductility of the wrought article makes it useful for further deformation processing into a desired different shape. The higher strength and ductility in the formed magnesium products may be beneficial to impact performance in automotive applications. The unexpected ductility of the hot deformed magnesium body is attributable to its zinc and cerium content and to hot deformation processing that contributes to an alteration in slip distribution and a recrystallized texture that favors basal dislocation activity.

Zinc and cerium are preferred elements for addition to magnesium for improved ductility and strength of the magnesium-zinc-cerium combination. An embodiment of the invention will be illustrated using zinc and cerium as additives in magnesium for markedly improving the ductility and strength at room temperature of certain exemplary magnesium-zinc-cerium alloys.

In the following embodiments a commercial grade of "pure" magnesium was used. The magnesium ingots typically included, as maximum amounts by weight, 0.3% manganese, 0.01% silicon, 0.01% copper, 0.002% nickel, 0.002% iron, and 0.02% others. These "impurities" are likely present in the compositions of this invention.

In one embodiment, a magnesium alloy comprising a small amount, up to about six weight percent zinc, and up to about one weight percent cerium may undergo a hot deformation process to fabricate a wrought metal object that exhibits enhanced room temperature ductility and strength as compared to that of magnesium and conventional magnesium alloys. The solubility of zinc in magnesium is approximately 6.2% at 340° C. The solubility of cerium in magnesium is approximately 0.1% at 500° C. Any excess zinc and cerium ultimately form intermetallics with magnesium and oxide particles within the alloy.

A hot deformation technique suitable for improving ductility in a magnesium-zinc-cerium alloy may be a conventional in-line hot extrusion process. In one embodiment, a magnesium alloy comprising up to about six weight percent zinc and up to about one weight percent cerium may be cast as a billet. The initial cast billet is suitably round in cross-section with a diameter of, for example, about 50 millimeters to typically about 300 millimeters, although larger billets are also extruded. The cast billet is preheated to a deformation temperature in the range of about 300° C. to 475° C. Precautions may be taken to ensure that the magnesium-zinc-cerium alloy billet is sufficiently lubricated during extrusion by any known metal lubricant such as, for example, graphite or boron nitride. The magnesium alloy billet may be direct extruded through a conventional circular or conical extrusion die possessing an extrusion ratio in the range of 10:1 to 60:1 at a speed in the range of 10 mm per second to 1000 mm per second of extrudate. Depending on the expected use of the extruded article and/or the particular configuration of the eventual final product, the magnesium-zinc-cerium alloy may be hot extruded into any one of a number of sizes and shapes known to those of ordinary skill in the art, such as, but not limited to, solid or hollow rods, I-beams, or other achievable extruded shapes. The enhanced ductility of these shapes may then be utilized by further working of the shapes (for example by bending or hydroforming) at room temperature.

In one embodiment, three different magnesium alloys containing zinc and cerium were cast as billets. The ZE20 alloy comprised 2 percent zinc and 0.2 weight percent cerium. The ZE40 magnesium alloy comprised 4 weight percent zinc and 0.2 weight percent cerium. The ZE60 magnesium alloy comprised 6 weight percent zinc and 0.2 weight percent cerium. The initial cast billets each had a diameter of 75 millimeters and a length of 230 millimeters. The cast billets were preheated to 425° C. Tubes of 25 millimeter diameter and 1.75 millimeter wall thickness were extruded for mechanical testing using a 500 ton press at 400° C. at various extrusion speeds ranging from 3 to 25 ft/min. The extrusion ratio was about 42. Results of the testing are shown in FIGS. 1 and 2 and are described below.

To analyze room temperature mechanical properties of the extruded tubes, samples of the extruded tubes were tested to evaluate yield strength, ultimate tensile strength, and percentage elongation at fracture. First, tensile specimens having a 25 mm gauge length and a 6.25 mm gauge diameter were tested with an Instron Universal Testing Machine at an average strain rate of $1\times10^{-3}$ $s^{-1}$. Three specimens were taken from different locations along the steady state portion of the extruded tubes and the average values were reported.

Figure 2:
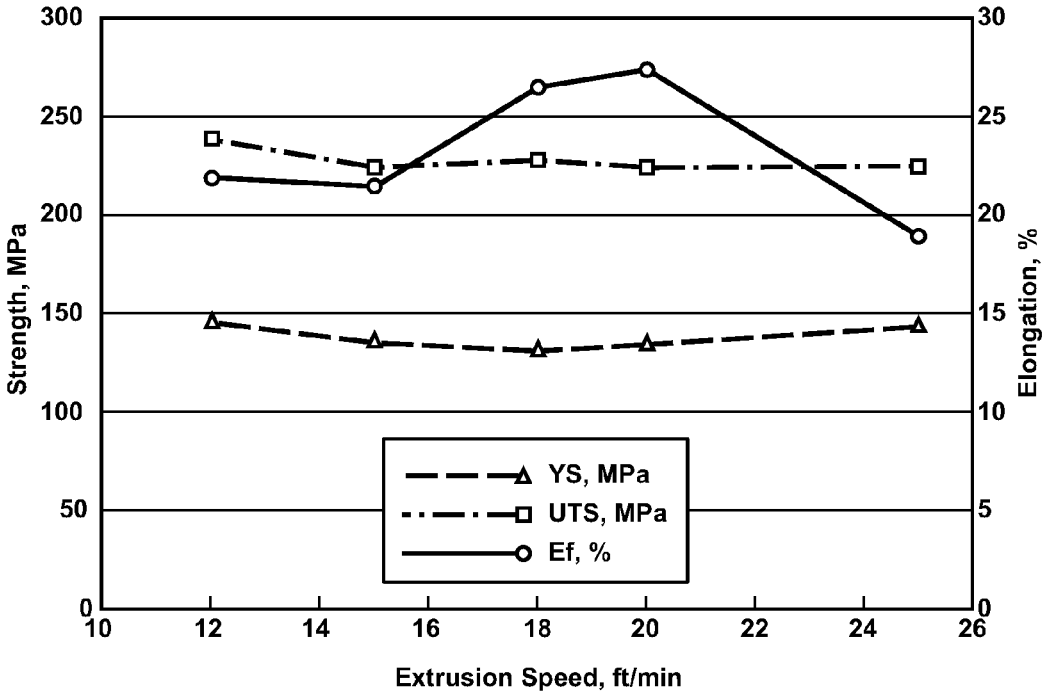
FIG. 2 is a graph of strength—yield strength (MPa), ultimate tensile strength (MPa), and elongation at fracture ( % )—of the magnesium-2wt % zinc-0.2wt % cerium alloy at various extrusion speeds (ft/min).

FIG. 1 shows the tensile properties of the three Mg—Zn—Ce alloys in comparison with the commercial extrusion alloy AZ31 and with a Mg-0.2 wt % Ce alloy. As shown in FIG. 1, at room temperature, tensile tests on the AZ31 sample revealed a yield strength of 166.4 MPa, an ultimate tensile strength of 266.7 MPa, and an elongation value 16.9%. Corresponding tests performed on the Mg-0.2 wt % Ce sample revealed a yield strength of 68.6 MPa, an ultimate tensile strength of 170 MPa, and an elongation value of 31%. Corresponding tests performed on the ZE20 sample revealed a yield strength of 134.5 MPa, an ultimate tensile strength of 225.1 MPa, and an elongation value of 27.4%. Corresponding tests performed on the ZE40 sample revealed a yield strength of 134.7 MPa, an ultimate tensile strength of 246.6 MPa, and an elongation value of 15.4%. Corresponding tests performed on the ZE60 sample revealed a yield strength of 136.3 MPa, an ultimate tensile strength of 288.5 MPa, and an elongation value of 15.5%.

As shown in FIG. 1, the ZE20 alloy has significantly higher strength compared to the Mg-0.2 wt % Ce alloy. For example, the ZE20 alloy had a 135 MPa yield strength, compared to 69 MPa for the Mg-0.2 wt % Ce alloy. And the ZE20 alloy had a 225 MPa ultimate tensile strength, compared to 170 MPa for the Mg-0.2 wt % Ce alloy. The ZE20 alloy has a slight reduction in elongation at fracture (27.4%) compared to the binary Mg-0.2 wt % Ce alloy (31%). The ZE20 alloy shows significantly higher ductility than the AZ31 alloy, having a 27.4% elongation at fracture compared to 16.9% for the commercial AZ31 alloy, which is a 62% increase in elongation. This was obtained with a minor reduction of about 16% in tensile strength of the ZE20 alloy compared to the AZ31 alloy. Also as shown in FIG. 1, increasing the Zn content, from 2% to 6%, increased the ultimate tensile strength of the Mg—Zn—Ce alloy, but the elongation was reduced considerably.

FIG. 2 shows the tensile properties of ZE20, the Mg-2 wt % Zn-0.2 wt % Ce alloy, at various extrusion speeds. The best properties are at extrusion speeds of 15-20 ft/min, and more particularly at 18-20 ft/min. While the strength (both yield and ultimate tensile strengths) of the alloy does not change significantly with extrusion speed, the elongation improves at high extrusion speeds of 18-20 ft/min. A further increase in extrusion speed resulted in poor surface quality of the extrusion and reduced ductility. It is noted that the maximum extrusion speed of 20 ft/min for the ZE20 alloy is about 25% higher than the maximum extrusion speed of 15 ft/min for the AZ31 alloy, indicating higher productivity for the new ZE20 alloy.

To analyze the microstructure characteristics of the extruded tubes, polished samples sectioned parallel and normal to the extrusion axis were prepared by first scraping 0.50 m off the leading end of the extruded tube to ensure that the material being examined represents a portion of the tube formed by way of steady state extrusion. Next, metallographic samples of the type needed were prepared and polished by standard methods. The samples were then etched in a solution containing 20 mL glacial acetic acid, 50 mL picric acid, 10 mL methanol, and 10 mL de-ionized water.

Polished samples cut parallel and normal to the extrusion axis were fabricated from both extruded rods and examined with a Nikon™ optical microscope interfaced with a Leco™ image analyzer to inspect the microstructure in both the longitudinal and transverse directions. Samples were also subjected to electron probe micro-analysis (EPMA) using a Cameca SX100 Electron Probe Microanalyzer to identify the metallurgical phases in the microstructure. The optical micrographs showed no anisotropy in grain morphology along either direction and indicate a fully recrystallized, nearly equi-axed grain structure with an average grain size of approximately 30 μm for the AZ91 sample and 45 μm for the ZE20, ZE40, and ZE60 samples.

Zinc in the magnesium solid solution is a major strengthening element in the magnesium zinc-cerium alloys. The higher zinc concentrations in the magnesium solid solution of ZE40 and ZE60 compared to the ZE20 alloy provide higher tensile strength in the alloys. Some cerium is present as a solid solution in the magnesium and some cerium is present as a fine distinct phase. Cerium is seen as contributing to the ductility and strength of the alloy in both forms.

The high ductility resulting from the addition of small amounts of cerium (as observed and explained in the above identified parent application) is only slightly reduced due to the fact that the zinc is substantially all in the solid solution of magnesium matrix and no distinct Zn—Ce phase was detected in the Mg—Zn—Ce alloys at the magnifications of analysis.

The practice of the invention is not limited to the specific illustrative embodiments used to illustrate its practices.

The invention claimed is:

1. A method of processing a magnesium-zinc-cerium alloy to improve its ductility and strength at room temperature, the method comprising:

providing a magnesium-zinc-cerium alloy billet consisting essentially of, by weight, zinc in an amount of about two percent, from about 0.2 to 0.5 percent cerium, and at the balance substantially magnesium, the billet being shaped with an predetermined straight-line axis for hot deformation; and extruding the magnesium-zinc-cerium alloy billet along the predetermined axis at a temperature of at least 300° C. to form a workpiece, wherein the extrusion ratio is in the range of 10:1 to 60:1, the as-extruded workpiece having a typical yield strength value of about 135 Mpa and a typical elongation at fracture of about 27%; and, thereafter, subjecting the extruded workpiece to a further deformation step at ambient temperature.

2. A method as set forth in claim 1 in which the magnesium-zinc-cerium alloy billet contains 2 percent cerium.

3. A method as set forth in claim 1 wherein extruding the magnesium-zinc-cerium alloy billet comprises:

heating the magnesium-zinc-cerium alloy billet to a deformation temperature in the range of about 300° C. to about 500° C.;

extruding the billet through an extrusion die at a speed in the range of about 10 mm/second to 1000 mm/second of extrudate to form an extruded workpiece, wherein the extrusion ratio is in the range of 10:1 to 60:1, the as-extruded workpiece having a typical yield strength value of about 135 MPa and a typical elongation at fracture of about 27%; and thereafter subjecting the extruded workpiece to a further deformation at ambient temperature.

4. A method as set forth in claim 3 wherein the magnesium-zinc-cerium alloy billet contains, by weight, about 0.2 percent cerium.

5. A method of processing a magnesium-zinc-cerium alloy to improve its ductility and strength at room temperature, the method comprising:

providing a magnesium-zinc-cerium alloy billet consisting essentially of, by weight, zinc in an amount of about two percent, about 0.2 percent cerium, and the balance substantially magnesium, the billet being shaped with an predetermined straight-line axis for hot deformation; and extruding the magnesium-zinc-cerium alloy billet along the predetermined axis at a temperature of at least 300° C. to form an extruded workpiece comprising a hollow or channeled rod, the as-extruded workpiece having a typical yield strength value of about 135 MPa and a typical elongation at fracture of about 27%.

6. A method of processing a magnesium-zinc-cerium alloy as recited in claim 5 in which the extruded workpiece is subjected to a further deformation step at ambient temperature.

7. A method of processing a magnesium-zinc-cerium alloy as recited in claim 5 in which the hollow rod extruded workpiece is a tube.

8. A method as set forth in claim 7 further comprising subjecting the deformed magnesium-zinc-cerium alloy tube to a hydroforming step at ambient temperature.

* * * * *